US008648789B2

(12) United States Patent
Willaert et al.

(10) Patent No.: US 8,648,789 B2
(45) Date of Patent: Feb. 11, 2014

(54) CONTROL DEVICE FOR CONTROLLING THE OUTPUT OF ONE OR MORE FULL-BRIDGES

(75) Inventors: Jurgen M. A. Willaert, Nijmegen (NL); Arjan Van Den Berg, Helmond (NL); Jozef M. G. Bongers, Grave (NL)

(73) Assignee: NXP, B.V., Eindhoven (NL)

( * ) Notice: Subject to any disclaimer, the term of this patent is extended or adjusted under 35 U.S.C. 154(b) by 1159 days.

(21) Appl. No.: 11/917,082

(22) PCT Filed: Jun. 7, 2006

(86) PCT No.: PCT/IB2006/051813
§ 371 (c)(1),
(2), (4) Date: Apr. 23, 2010

(87) PCT Pub. No.: WO2006/131890
PCT Pub. Date: Dec. 14, 2006

(65) Prior Publication Data

US 2010/0277408 A1 Nov. 4, 2010

(30) Foreign Application Priority Data

Jun. 10, 2005 (EP) ..... 05105126

(51) Int. Cl.
*G09G 3/36* (2006.01)

(52) U.S. Cl.
USPC ..... 345/102; 345/87; 363/98; 363/132

(58) Field of Classification Search
USPC ..... 345/87–89, 98, 100, 102, 211, 212, 345/213; 315/224; 349/61; 363/74–99, 363/123–139
See application file for complete search history.

(56) References Cited

U.S. PATENT DOCUMENTS

| | | | | |
|---|---|---|---|---|
| 6,707,264 | B2 * | 3/2004 | Lin et al. | 315/307 |
| 6,804,129 | B2 * | 10/2004 | Lin | 363/98 |
| 6,943,506 | B2 * | 9/2005 | Moon | 315/323 |
| 7,158,390 | B2 * | 1/2007 | Choi et al. | 363/17 |
| 7,180,247 | B2 * | 2/2007 | Kawarazaki | 315/209 R |
| 7,233,113 | B2 * | 6/2007 | Ongaro et al. | 315/219 |
| 7,417,616 | B2 * | 8/2008 | Min et al. | 345/102 |
| RE42,182 | E * | 3/2011 | Yu | 345/102 |
| 2003/0201967 | A1 * | 10/2003 | Yu | 345/102 |
| 2003/0234762 | A1 * | 12/2003 | Nakatsuka et al. | 345/102 |
| 2004/0113883 | A1 * | 6/2004 | Kim et al. | 345/102 |
| 2005/0030776 | A1 | 2/2005 | Lin | |

(Continued)

FOREIGN PATENT DOCUMENTS

| | | |
|---|---|---|
| EP | 1401246 A2 | 3/2004 |
| EP | 1521507 A1 | 4/2005 |

OTHER PUBLICATIONS

Nakashima, S; et al "Piezoelectric-Transformer Inverter With Maximum-Efficiency Tracking and Dimming Control" APEC 2002. 17th Annual IEEE Applied Power Electronics Conference and Exposition, Dallas, TX. Mar. 10-14, vol. 2, Conf. 17, Mar. 10, 2002, pp. 918-923.

*Primary Examiner* — Dmitriy Bolotin

(57) ABSTRACT

A control device (701) for controlling the output of one or more full-bridges (101, 102) is described. The control device (701) reduces the amount of electromagnetic emissions by staggering the switching the outputs from the full-bridge inverters (101, 102). This is achieved by synchronizing the outputs to be symmetrical about a synchronization pulse (305).

29 Claims, 12 Drawing Sheets

(56) References Cited

U.S. PATENT DOCUMENTS

2005/0099139 A1* 5/2005 Gu et al. ..... 315/224
2005/0285549 A1* 12/2005 Moon ..... 315/312
2008/0136355 A1* 6/2008 Han et al. ..... 315/307

* cited by examiner

CONTROL DEVICE FOR CONTROLLING THE OUTPUT OF ONE OR MORE FULL-BRIDGES

The present invention relates to a control device for controlling the output of one or more full-bridge inverters.

Backlights which are used in display panels (such as LCD displays) are made up of a number of lamps. The backlight is controlled by one or more full-bridge inverters, each of which control one or more lamps. A typical individual full-bridge inverter 10 and lamp arrangement is depicted in FIG. 1.

The typical full-bridge inverter 10 comprises a first half-bridge 13, a second half-bridge 17 and is controlled by a controller 26. It will be understood that the controller 26 may also control more than one full bridge.

The first half-bridge 13 consists of a first transistor 12 and a second transistor 14. The second half bridge inverter 17 consists of a third transistor 16 and a fourth transistor 18. The first transistor 12, second transistor 14, third transistor 16 and fourth transistor 18 are switching transistors. The controller 26 controls the switching of the first, second, third and fourth transistors 12, 14, 16, 18.

A synchronisation (SYNC) pulse train is provided by an external oscillator (not shown in FIG. 1) to the controller 26. The frequency of the SYNC pulse train is determined by the manufacturer of the display so as not to interfere with the drive signals for the LCD display panel and is typically 50 kHz. To ensure that all the inverters in the backlight are operating at the correct frequency, the SYNC pulse can also be fed to a number of similar full-bridge inverter controllers to control a number of full-bridges with their associated loads.

The output of the full-bridge is connected to a resonant load 11, which comprises a DC blocking capacitor 20 which is connected, in series, to a primary winding of a transformer 22. The skilled person will appreciate that parasitic capacitances and inductances also exist, although these are not shown for brevity. The secondary winding of the transformer 22 is connected to a resonant capacitor 27 and, in this case, to a lamp 24, which is typically a Cold Cathode Fluorescent Lamp (CCFL), although other lamps may be used. The current through the lamp 24 is sensed using a resistor 29. It will be understood that other methods of sensing the current may be used. The voltage across the resistor 29 (which is indicative of the current) is fed to the controller 26. This voltage is fed directly to the controller 26. As an alternative, a DC representation of the sensed voltage may be fed to the controller 26.

As already noted, the controller 26 may be used to control a number of lamps 24. In this case, the average current of the lamps 24 is derived and fed back to the controller 26. However, for ease of understanding the use of only a single lamp will be explained.

Referring to FIGS. 2 and 3, the operation of the full-bridge inverter 10 and load 11 of FIG. 1 will now be described. As shown in FIG. 2, the SYNC pulse train 305 (FIG. 3) is fed into a feedback control unit 266. The frequency of the SYNC pulse train 305 is fixed. In response to a first SYNC pulse 302 in the SYNC pulse train 305, the first half bridge driver 262 is controlled by the feedback controller 266 to drive the first transistor 12 and the second transistor 14 so that the output ($V_{HB1}$) of the first half bridge is high. The second half bridge is driven low at this time so consequently the output of the full-bridge inverter ($V_{FB}$), is high 306. The feedback controller 266 notes the time at which the output of the first half bridge 13 goes high.

The amplitude of the current used by the lamp 24 is indicated by the signal $V_L$. In reality, the signal $V_L$ can be any representation of the, typically sinusoidal, current through the lamp 24, as would be understood by the skilled person. $V_L$ is provided to the feedback controller 266. As the frequency of the SYNC pulse train 305 (and thus the switching frequency of the full-bridge inverter 10) is constant, the amplitude of the current provided to the lamp 24 is controlled by the width of the pulse output from the full-bridge. Thus, to increase the current to the lamp 24, the width of the output pulse is increased. The feedback controller 26 determines the pulse width in accordance with the current indicated by voltage $V_L$.

The width of the positive output pulse from the full bridge inverter 10 is equal to the phase difference between the output of both the first and second half-bridges 13, 17 being high. In other words, the feedback controller 266 controls the first and second half-bridges 16 and 17 so that the difference in time between these going high is the same as the required width of the output pulse from the full-bridge inverter. Thus, as the feedback controller 266 knows when the output of the first half-bridge 13 goes high, it determines when the output from the second half-bridge 17 should be high and controls the second half bridge drive unit 264 accordingly.

For the output from the second half-bridge 17 ($V_{HB2}$) to go high, the second half bridge driver 264 controls the third transistor 16 and the fourth transistor 18 accordingly. Thus, as seen at point 301 in FIG. 3, when the output from both the first and second half-bridge 13 and 17 is high the output of the full bridge ($V_{FB1}$) is zero.

However, when the output from the full-bridge inverter 10 ($V_{FB}$) is to be negative, the output ($V_{HB1}$) of the first half-bridge 13 is low (this is in response to a second SYNC pulse 303 in the SYNC pulse train 305), whilst the output ($V_{HB2}$) of the second half-bridge 17 is high. Again, the width of the negative output pulse from the full-bridge is determined in accordance with the current required by the lamp 24.

When the output from both the first and second half-bridges ($V_{HB1}$ and $V_{HB2}$) is low, the output from the full-bridge is also zero.

Sometimes it is necessary to provide a number of full-bridge inverters 10 each driving one or more lamps 24 in the backlight. In order to ensure the frequency of the outputs from each full bridge inverter 10 is the same, the SYNC signal 305 is provided to each controller in the inverter.

An array of inverters (including the associated controllers) with loads is depicted in FIG. 4. The synchronisation (SYNC) pulse train 305 is provided to a known first full-bridge inverter controller 261 and a second known full-bridge inverter controller 262 each corresponding to the controller 26 of FIGS. 1 and 2. The SYNC pulse train 305 is generated by an external source 407. This is fed to the first known full-bridge inverter controller 261 and the second known full-bridge inverter controller 262. The first known full-bridge inverter controller 261 is connected to a first full-bridge inverter 101, which is, in turn, connected to a first resonant load 111 and the second known full-bridge inverter controller 262 is connected to a second full-bridge inverter 102, which is, in turn, connected to a second resonant load 112. These are the same as those described with reference to FIG. 1.

A timing diagram for the inverters of FIG. 4 is shown in FIG. 5. As the SYNC pulse train 305 is provided to both the first and the second known full-bridge inverter controllers 101, 102, the frequency of the output from the first and second full bridge inverters is the same. However, as is seen, although the frequency of both outputs is the same, a phase difference 506 exists between the respective outputs 502, 504 of the first and second known full-bridge inverters 101, 102. This is due to one switching edge of the output of the first and second full-bridge inverters being synchronised to the SYNC pulse train 305, whilst the other edge is determined by each regulation loop, which might not coincide with one another due to the tolerances of the components used in each of the inverters and/or lamps This phase difference leads to a non-uniform back lit display. Moreover, as the rising edges of the full bridge inverters are synchronised, the disturbances they cause occur at the same time, which can increase the electromagnetic emissions of the inverter.

Additionally, the above arrangement has the disadvantage that the SYNC pulse train 305 sets the frequency of the signal output from the first and second full-bridge inverters 101,102, however, there is no useful phase information in the SYNC pulse train for the first and second full-bridge inverter controllers 261, 262. This may result in the output from the first and second full-bridge inverters being 180° out of phase, i.e. being sent high when should be sent low and vice versa.

The present invention aims to address these problems.

According to an aspect of the present invention, there is provided a controller for controlling a first and second full-bridge inverter, comprising control means for staggering the timing of the switching of the outputs from the first and the second full-bridge inverter. By staggering the timing of the output from a first and second inverter the amount of disturbance and thus electromagnetic emissions is reduced.

In one embodiment the control means is operable to stagger the timing of the switching by controlling the output of the first and second inverter to be substantially symmetrical about a point on a synchronisation pulse in a received synchronisation pulse train. This point can be the same point on successive pulses in the pulse train or not.

According to another aspect of the present invention, there is provided a controller for controlling a full-bridge inverter, comprising means operable to receive a synchronisation pulse and control means for controlling the output of the full-bridge inverter to be substantially symmetrical about a periodic point on the synchronisation pulse.

In one embodiment, the controller comprises an oscillator for generating a periodic signal whose frequency is a multiple integer of the frequency of the received synchronisation pulse. In this case, the control means may be arranged so that the output of the full-bridge inverter is a pulse which is symmetrical about with the same periodic point on the generated signal.

The oscillator may be arranged so that the generated signal is a V-shaped signal and the periodic point on the generated signal may be substantially the minimum or maximum value. Alternatively, the oscillator may be arranged so that the generated signal is a saw-tooth signal and the periodic point on the generated signal may be along the sloping edge of the saw-tooth signal.

In another embodiment, the controller comprises synchronisation logic for generating a pulse train in accordance with the generated periodic signal. In this case, the synchronisation logic may be operable to receive the synchronisation pulse train and to synchronise the generated periodic signal to either the received synchronisation pulse train or the generated pulse train having the highest frequency.

The controller may comprise a control voltage generating means for generating a control signal, wherein the width of the output pulse from the inverter is determined in accordance with the value of the control signal. In this case, the width of the output pulse from the inverter may be determined by the generated periodic signal being less than the control signal.

The inverter may be connected to a resonant load and the control means may be operable to generate the output pulse in accordance with the power requirements of the load.

According to another aspect of the present invention there is provided a device comprising a first and second controller having any or all of the above features wherein the synchronisation pulse is common to both the first and second controller.

According to yet another aspect of the present invention there is provided a semiconductor integrated circuit, comprising at least one pin connectable to a printed circuit board; and a controller having any or all of the above features.

According to still another aspect of the present invention there is provided a display panel comprising a backlight; a pixel array; and a semiconductor integrated circuit according to the previous aspect, for control thereof.

According to a further aspect of the present invention there is provided a method of controlling a first and second full-bridge inverter, comprising staggering the timing of the switching of the outputs from the first and the second full-bridge inverter.

In one embodiment, the staggering of the timing of the switching is achieved by controlling the output of the first and second inverter to be substantially symmetrical about a point on a synchronisation pulse in a received synchronisation pulse train.

According to another aspect of the present invention there is provided a method of controlling a full-bridge inverter, comprising receiving a synchronisation pulse train and controlling the output of the full-bridge inverter to be substantially symmetrical about a point on successive pulses in the synchronisation pulse train. This point may be the same point or a different point on successive pulses.

In one embodiment the method comprises generating a periodic signal whose frequency is a multiple integer of the frequency of the received synchronisation pulse. In this case, the method may comprise, generating a pulse to be output from the full-bridge inverter, the output pulse being symmetrical about the same periodic point on the generated signal.

In this case, the generated signal may be a V-shaped signal and the periodic point on the generated signal may be substantially the minimum or maximum value. Alternatively, the generated signal may be a saw-tooth signal and the periodic point on the generated signal may be along the sloping edge of the saw-tooth signal.

In another embodiment, the method comprises generating a pulse train in accordance with the generated periodic signal. In this case, the method may comprise receiving the synchronisation pulse train and to synchronise the generated periodic signal to either the received synchronisation pulse train or the generated pulse train having the highest frequency.

In a further embodiment, the method comprises generating a control signal, wherein the width of the output pulse from the inverter is determined in accordance with the value of the control signal. In this case, the width of the output pulse from the inverter is determined by the generated periodic signal being less than the control signal.

According to another aspect of the present invention there is provided a control device of inverter controllers for controlling an array of full-bridge inverters, the device comprising a first and a second full bridge inverter controller for controlling the output of a first and a second full-bridge inverter; and each controller comprising synchronisation means operable to generate a first and a second synchronisation signal for the first and the second full bridge inverter controller respectively; wherein each controller is arranged to control the first and the second output pulse to be substantially symmetrical about a substantially coincident point on the first and second synchronisation signal.

In one embodiment, the first and second full-bridge inverter controllers comprise a first and a second output signal control means operable to generate a first and a second control signal respectively, wherein the width of the first and the second output pulse is determined in accordance with the value of the first and the second control signal. In this case, the duration of the first and second output pulse is determined by the duration of the first and second synchronisation signal being less than the first and the second control signal.

In another embodiment, the synchronisation means is operable to generate a V-shaped first and second synchronisation signal. In this case, the coincident point is the minimum or maximum value of the first and second synchronisation signal.

In a further embodiment, the synchronisation means is operable to receive a synchronisation pulse train to synchronise the first and the second synchronisation signal thereto. In this case, the synchronisation means may be operable to generate the first and second synchronisation signals having a frequency of twice that of the synchronisation pulse train.

In another embodiment, the first and the second inverter are connected to a first and a second resonant load. In this case, the controllers may be operable to generate the first and the second output pulse in accordance with the power requirements of the first and the second resonant load.

According to another aspect of the present invention there is provided a controller for controlling a first and second full-bridge inverter, comprising means for staggering the switching of the outputs from the first and second full-bridge inverter.

In an embodiment the means are operable to stagger the switching by controlling the output of the first and second inverter to be symmetrical about a coincident point on a synchronisation pulse in a synchronisation pulse train.

Embodiments of the present invention will now be described, by way of example only, and with reference to FIGS. 6 to 13 of the accompanying drawings, in which.

Figure 1:
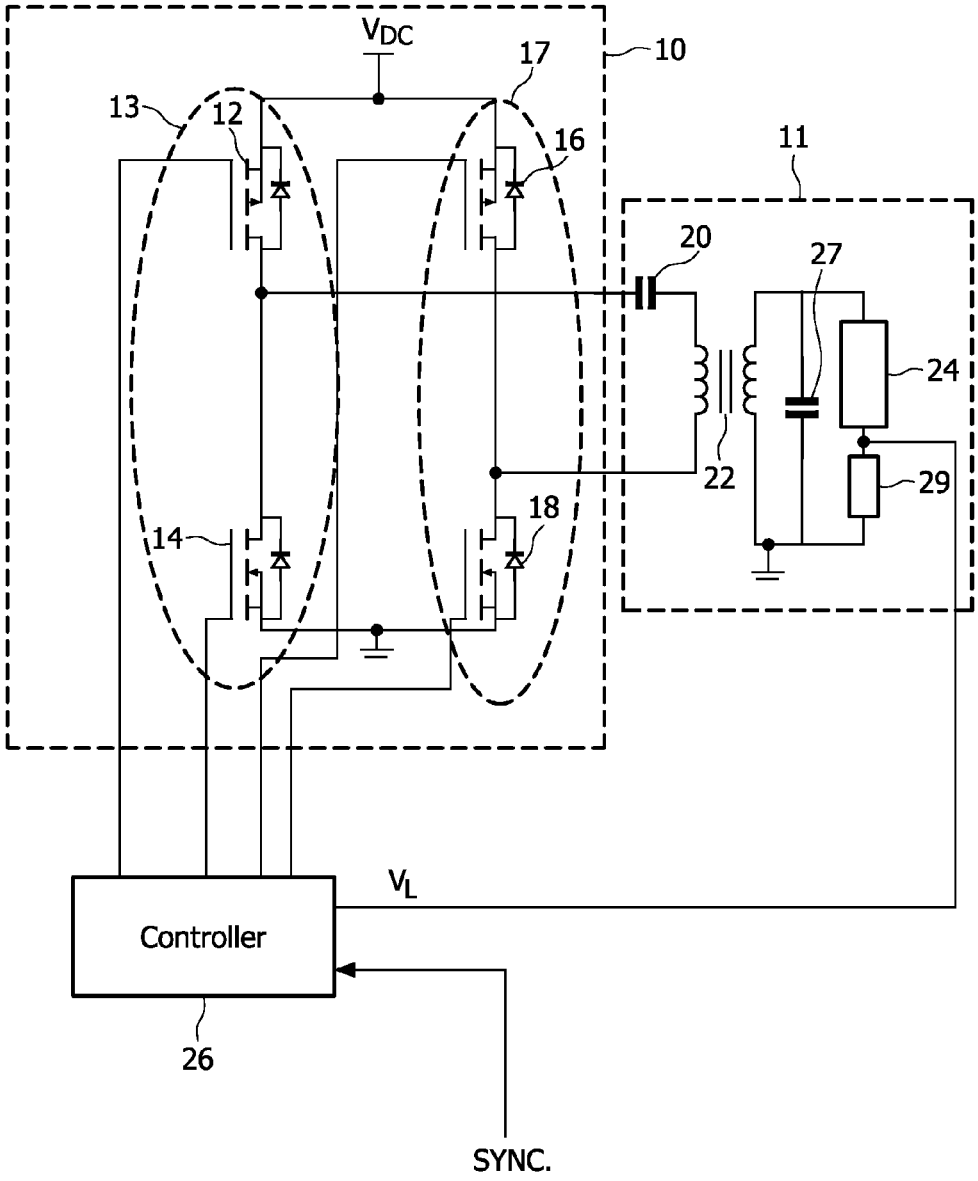
FIG. 1 (PRIOR ART)
FIG. 1 depicts a known full-bridge inverter including controller.
Figure 2:
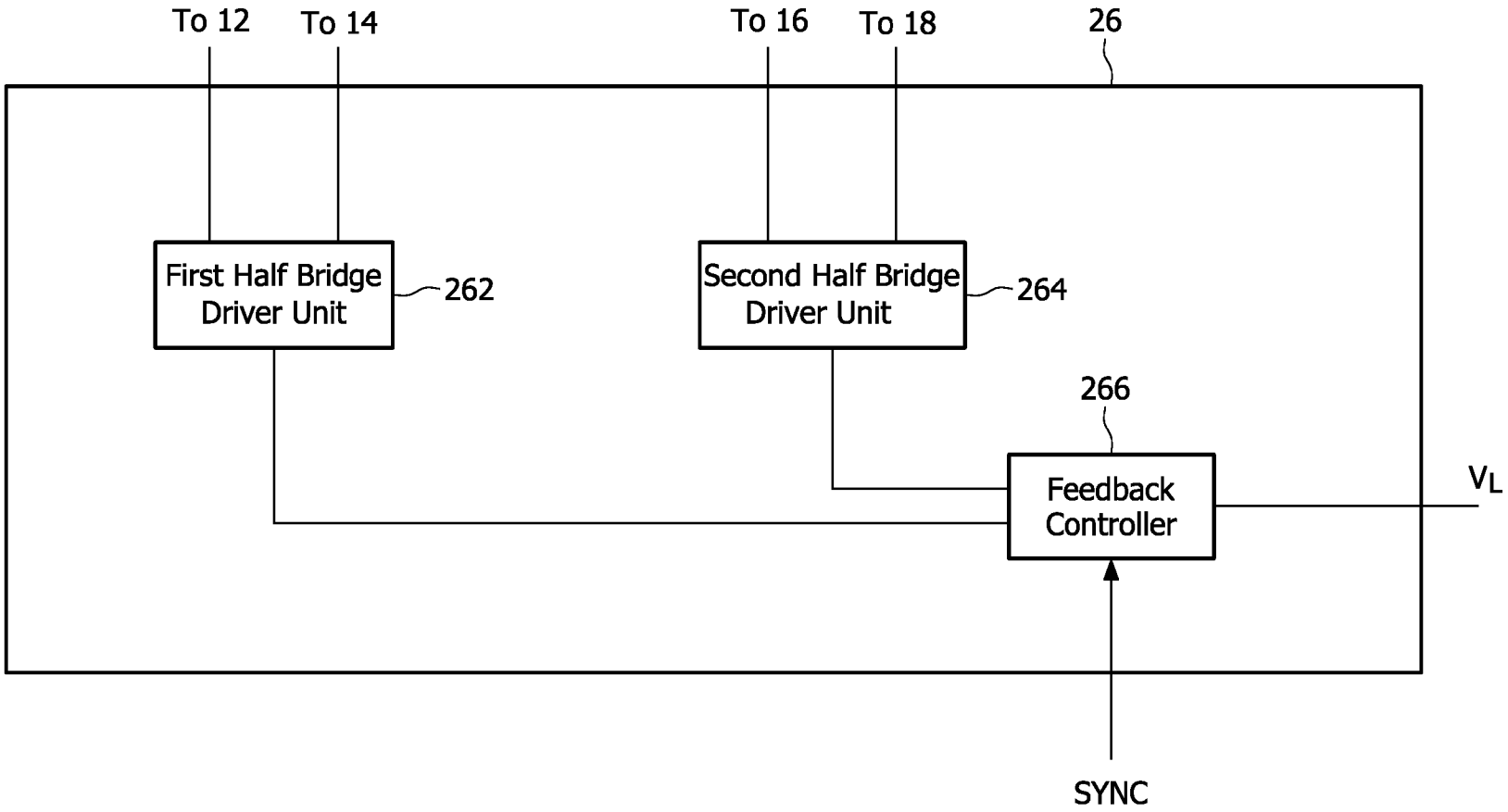
FIG. 2 (PRIOR ART)
FIG. 2 depicts the controller for controlling the full-bridge inverter of FIG. 1.
Figure 3:
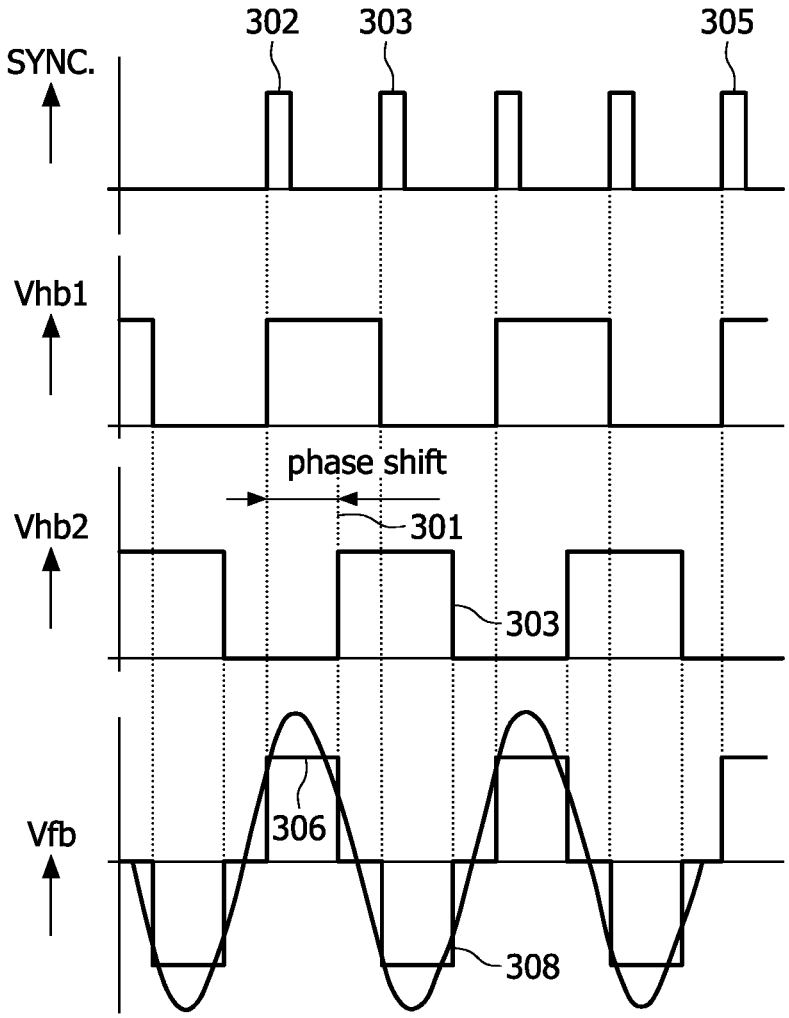
FIG. 3 (PRIOR ART)
FIG. 3 depicts a waveform from each of the half-bridges which make up the full-bridge inverter of FIG. 1.
Figure 4:
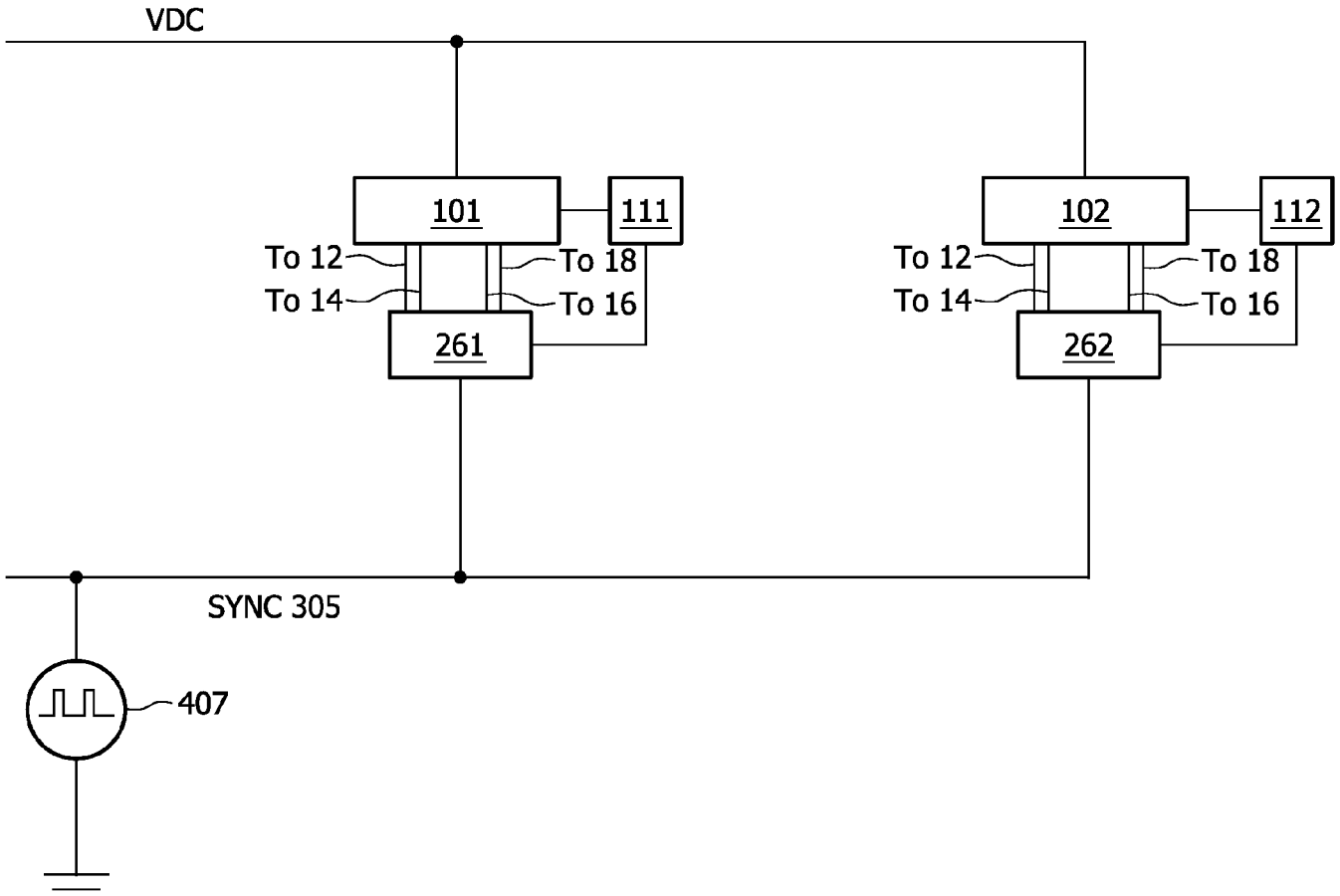
FIG. 4 (PRIOR ART)
FIG. 4 depicts a known full-bridge inverter array.
Figure 5:
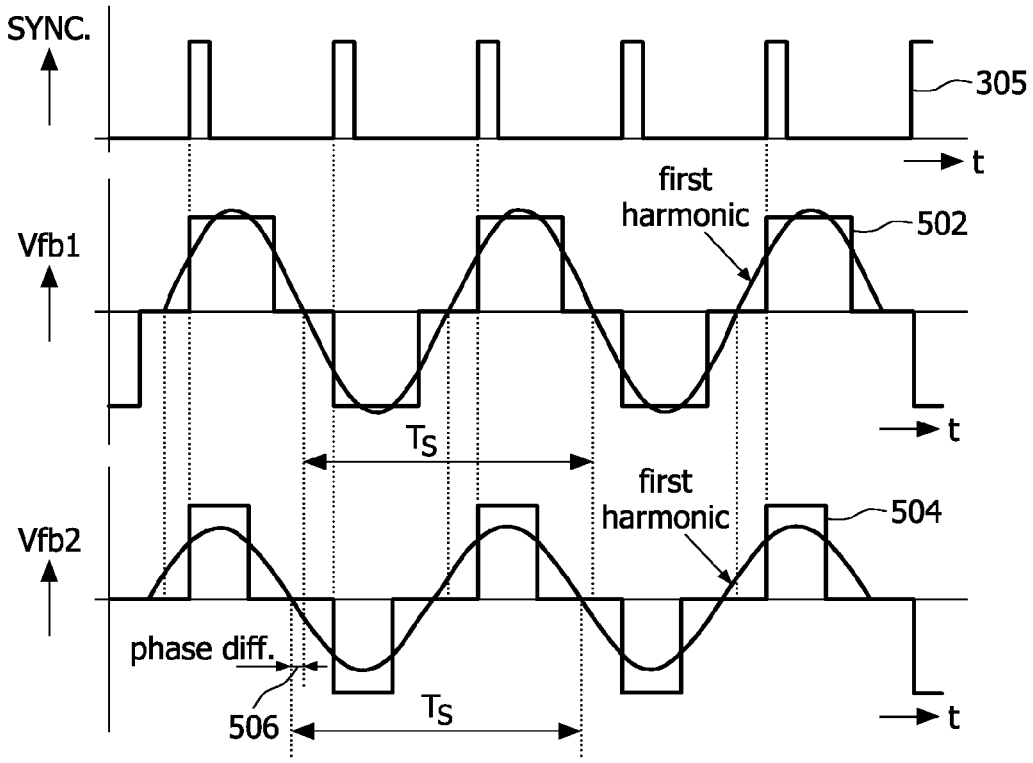
FIG. 5 (PRIOR ART)
FIG. 5 depicts the waveform from the full-bridge inverter array of FIG. 4.
Figure 6:
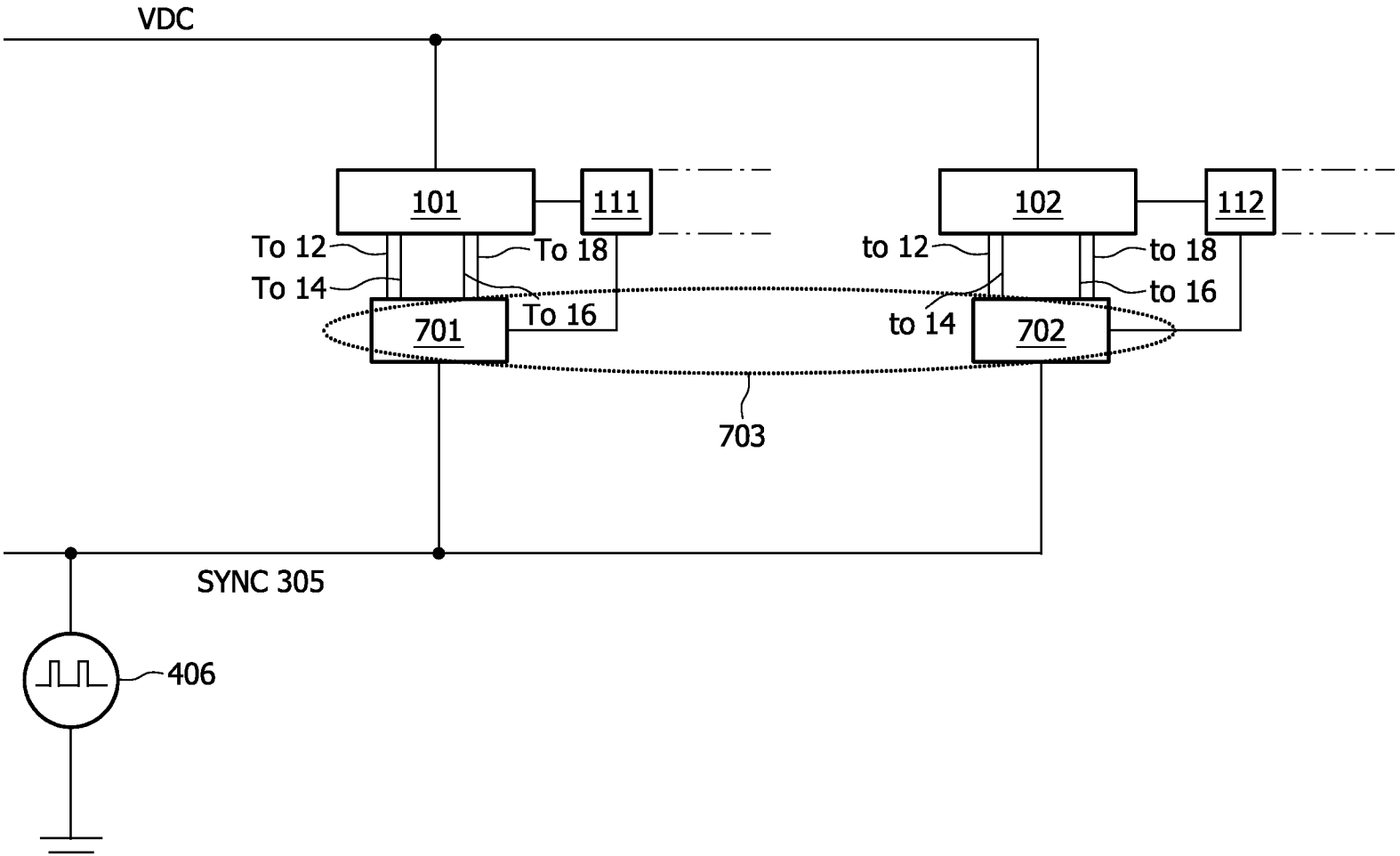
FIG. 6 depicts a full-bridge inverter array according to a first embodiment of the present invention.
Figure 9:
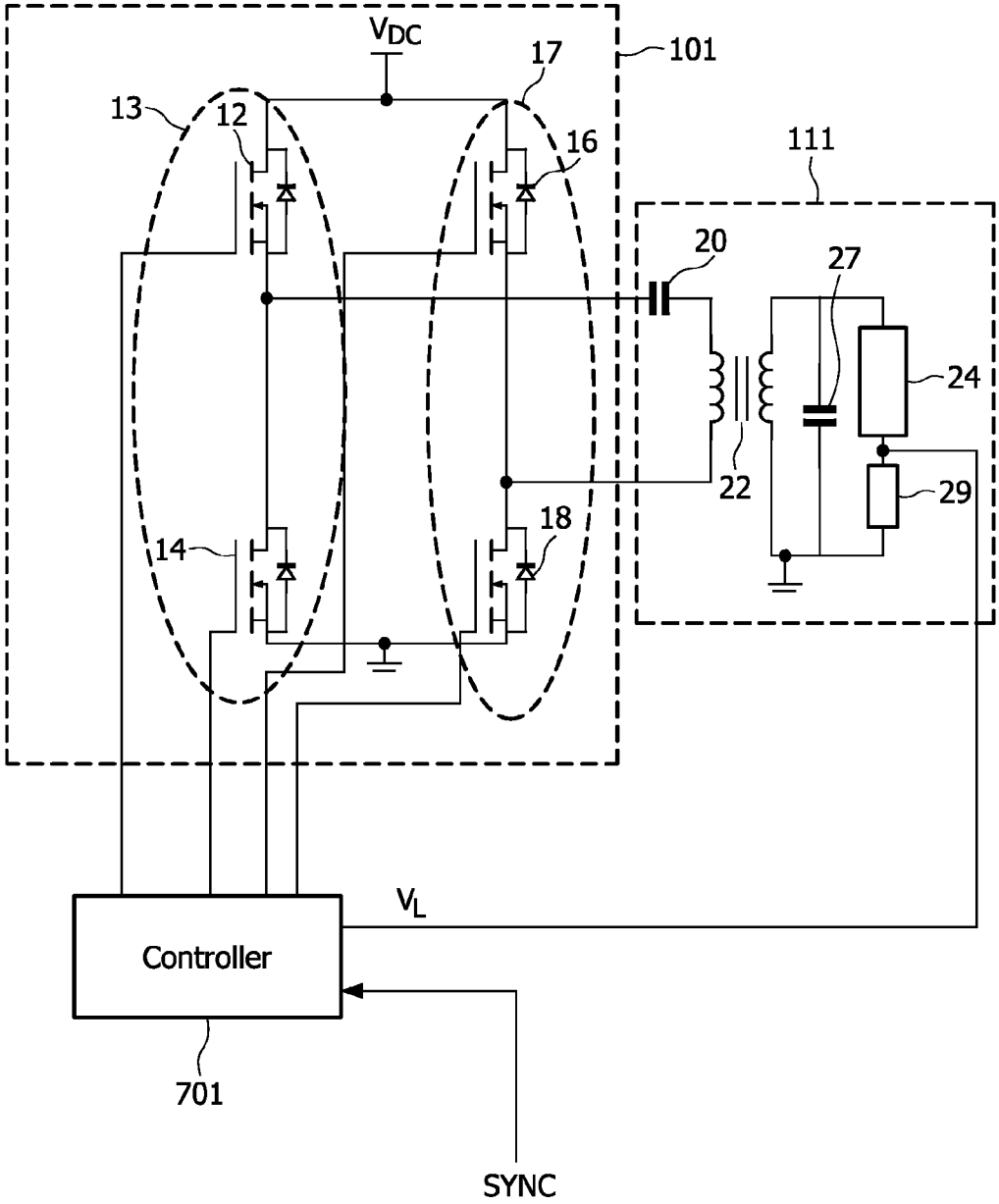
FIG. 9 depicts a full-bridge inverter used in the array of FIG. 6.

Referring to FIGS. 6 and 9, a first full-bridge inverter 101 and a second full-bridge inverter 102 include a first and second full-bridge inverter controller 701, 702 respectively. The first and second full-bridges in the first and second full bridge inverters 101, 102 have the same construction as the full-bridges explained above, and so will not be described here. The first and second full-bridge inverters 101, 102 are also connected to first and second resonant loads 111, 112 which may comprise one or more CCFLs (denoted by the dashed lines). Again, as the first and second resonant loads are the same as discussed previously, they will not be described here.

The synchronisation (SYNC) pulse train 305 is generated by a switching transistor (not shown) located between a voltage rail VDC and a bias resistor (not shown). The bias resistor is connected between the emitter of the switching transistor and ground. The base of the switching transistor is connected to a clock oscillating at an appropriate frequency. Thus, the SYNC pulse train 305, which has the same frequency as the clock, is generated. However, as other methods of generating the SYNC pulse train 305 are also possible, for brevity, the synchronisation pulse train generator is represented by external source 406.

Figure 7:
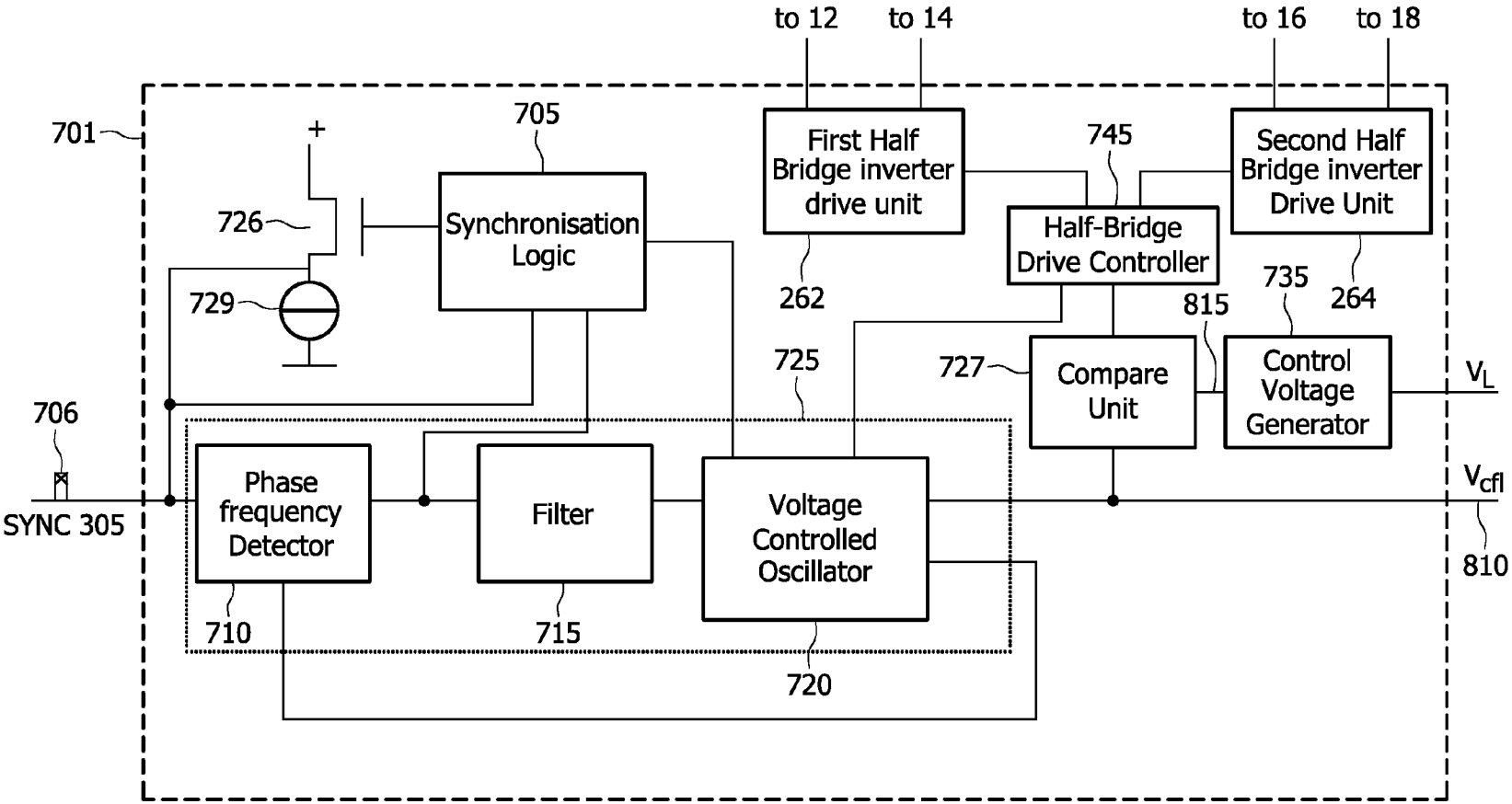
FIG. 7 depicts a controller of a first inverter in the array of FIG. 6.

The SYNC pulse train 305 is fed into the first and the second full-bridge inverter controllers 701, 702. The detailed construction and function of the first full bridge inverter controller 701 will now be described with reference to FIG. 7. It is noted that the construction and function of the second full-bridge inverter controller 702 will be identical to that of the first full-bridge inverter controller 701 as will become apparent.

The SYNC pulse train 305 (which is generated by the external source 406 in FIG. 6) appears on pin 706 and is fed into the input of a phase locked loop 725 (PLL). The phase locked loop 725 comprises a phase frequency detector 710 connected to a filter 715 which in turn is connected to a voltage controlled oscillator (VCO) 720. One output of the VCO 720 is fed back to an input of the phase frequency detector 710 which compares the frequency of the SYNC pulse train 305 with the oscillation frequency of the VCO 720. It will be appreciated that if no SYNC pulse train 305 were applied, the VCO 720 would oscillate at a minimum oscillation frequency. Therefore, the frequency of the SYNC pulse train 305 should be greater than this minimum oscillation frequency.

In response to this comparison, an error signal is generated by the phase frequency detector 710 which is filtered and integrated by the filter 715 for use by the voltage controlled oscillator 720. Additionally, the filter 715 ensures that the feedback loop in the phase locked loop 725 is stable. The error signal is indicative of the difference between the phase of the synchronisation pulse train 305 and the phase of the output of the VCO. The output of the filter 715 is indicative of the frequency of oscillation of the VCO 720.

The output of the filter 715 is fed to the input of the VCO 720 which increases or decreases its frequency of oscillation in response. Consequently, the VCO 720 begins to oscillate at the same frequency as the SYNC pulse train 305. Also the oscillation becomes in phase with the SYNC pulse train 305.

Another of the outputs of the VCO 720 is a V-shaped waveform 810 having a frequency that is twice that of the SYNC pulse train 305 when the output from the VCO 720 is locked in phase and frequency to the SYNC pulse train 305. However, other multiples of frequency and waveforms are also envisaged as will be appreciated by a skilled person.

In the preferred embodiment, the V-shaped oscillation waveform moves between two voltage levels (for example 1 Volt and 3 Volts) and the lowest value of the V-shaped waveform 810 is coincident (contemporaneous) with the leading edge of a pulse in the SYNC pulse train 305. As the frequency of the output of the VCO 720 is locked to the frequency and phase of the SYNC pulse train 305 which is, in this case, coincident with the lowest value of the V-shaped waveform, the output from the VCO 720 is symmetrical about the leading edge of the synchronisation pulse. This ensures that the output from the full-bridge inverter 101 is symmetrical about the leading edge of the synchronisation pulse. It will be understood, that although the minimum point of a V-shaped waveform is preferable, the advantages of the present invention will be realised as long as the output of the full-bridge inverter is symmetrical about any point on the pulse in the SYNC pulse train 305. For example, instead of the V-shaped waveform, the synchronisation pulse 305 can be synchronised to the zero point in a sine wave.

Figure 10:
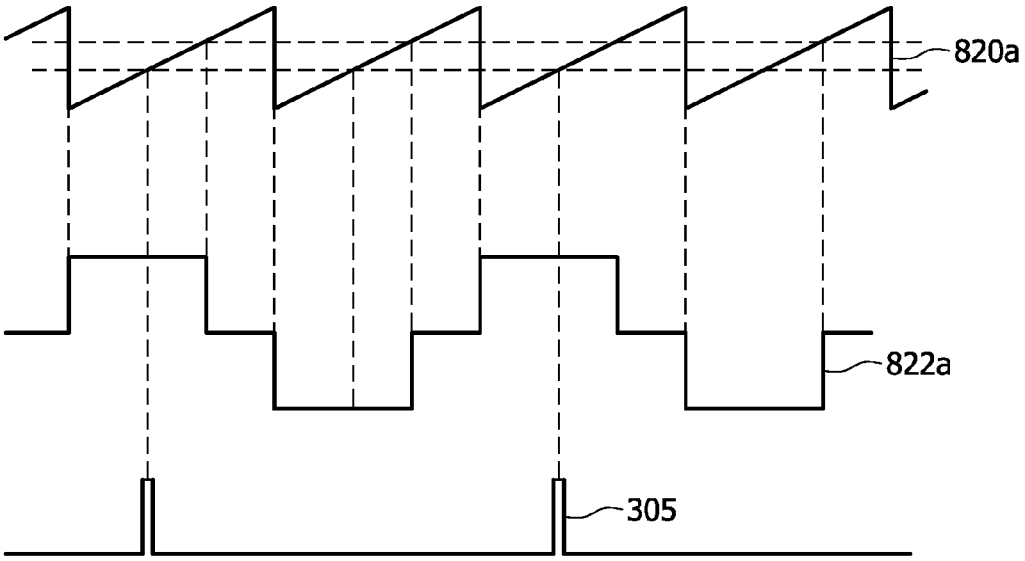
FIG. 10 depicts an alternative waveform from the full-bridge inverter of FIG. 9.

As noted above, the V-shape waveform 810 may be replaced by another shaped waveform, for example in FIG. 10, where the output pulse from the first full-bridge inverter 822*a* is synchronised to the same periodic point on the ramp in a periodic saw-tooth signal 820*a*; where the saw-tooth signal is only locked in frequency to the SYNC pulse train 305. In this case, the V-shape waveform is replaced with a saw-tooth waveform the phase of which is shifted with respect to the SYNC pulse train by an amount within the range corresponding to half the pulse width of the full bridge output.

Referring back to FIG. 7, the error signal from the phase frequency detector 710 is also fed to synchronisation logic 705 which controls the gate of a logic switch 726. The logic switch 726 is preferably a MOSFET which switches the pin 706 to a logic level high under the control of the synchronisation logic 705. Consequently, although the foregoing has described the SYNC pulse train 305 as being applied as an input on pin 706, pin 706 may also be used as an output. Pin 706 is used as an output in a second embodiment of the present invention which will be described hereinafter. Pin 706 is only pulsed to logic high if no incoming pulse is seen during one full bridge frequency period and the VCO 720 is at the minimum oscillation frequency.

In-between pulsing the pin 706 to logic high, the synchronisation logic listens for other, externally provided, pulses (from a pulse train) on the pin 706. The pulse train may be provided either by the SYNC pulse train 305, as in the first embodiment, or by another controller operating according to the second embodiment explained later. If a pulse from the pulse train is heard on pin 706 inbetween pulsing the pin 706, the synchronisation logic 705 disables the pulsing and the VCO 720 synchronises to that pulse train. This is because if a pulse is received on pin 706 from a pulse train in-between the synchronisation logic 705 pulsing the pin 706, the received pulse train will be of a higher frequency than the minimum oscillation frequency of the VCO 720. Since a second controller only pulses the pin 706 if its VCO is at its minimum frequency, the second controller providing the in-between pulse cannot decrease in frequency. Accordingly, synchronisation is achieved by increasing the frequency of the first controller.

It will be appreciated that the synchronisation logic 705 delays listening to pin 706 after pulsing the pin high so that the synchronisation logic 705 does not hear that pulse which has just been generated.

The output from the VCO 720 (which is synchronised both in phase and in frequency with the synchronisation pulse train 305) is fed into a compare unit 727. Also fed into the compare unit 727 is the output from a control voltage generator 735. The output from the compare unit 727 is fed to a half bridge drive controller 745. Also fed to the half-bridge drive controller 745 is a further signal from the VCO 720. The VCO 720 provides polarity information to the half-bridge drive controller 745 in accordance with the SYNC pulse train 305 as explained later. The first and second half bridges 262, 264, are switched according to the output signals of the half bridge drive controller 745 as described above.

Figure 8:
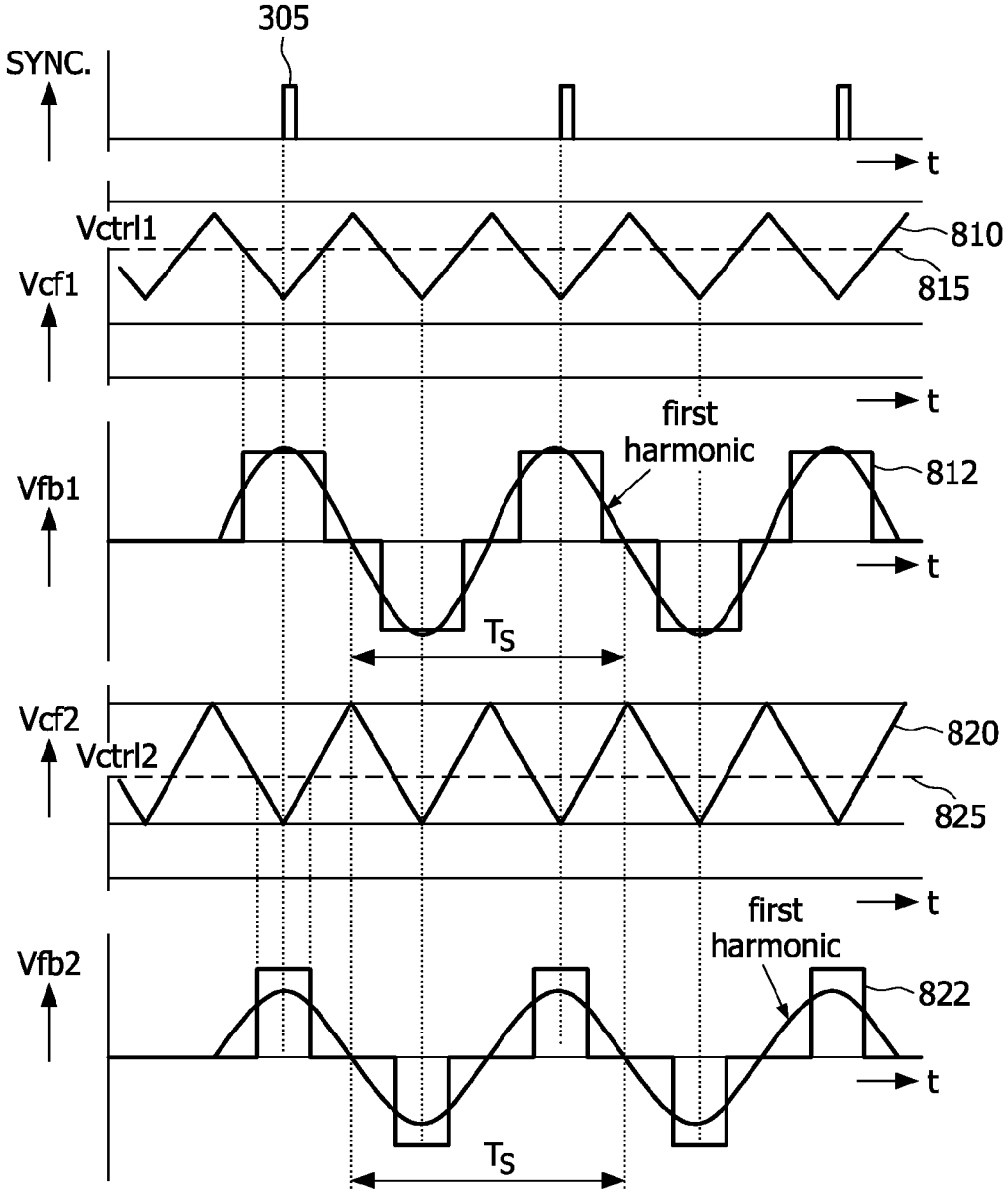
FIG. 8 depicts a waveform from the full-bridge inverter array of FIG. 6.

Referring to FIG. 8, the control voltage generator 735 generates a control voltage 815 in accordance with the voltage $V_L$ that is indicative of the current used by the resonant load 111. Thus, if the current used by the load 111 increases, the control voltage 815 increases. The current used by the resonant load 111 is determined in the same manner as described for the prior art. The compare unit 727 compares V-shaped waveform 810 with control voltage 815 and determines from these two waveforms the required pulse width of the output from the first full-bridge inverter 101 to achieve the given output current of the load 111. The control voltage 815 is a DC voltage, which provides the appropriate pulse width at the frequency of the V-shaped waveform; this frequency corresponding to double the switching frequency of the first full-bridge inverter 101. Thus, the positive output pulse coincides with the synchronisation pulse and so polarity information is provided for the first full bridge output by the synchronisation pulse. Accordingly, the full bridge output signal has equal positive and negative pulse widths and has the same frequency as the synchronisation pulse train.

The compare unit 727 compares the value of the V-shaped waveform signal 810 with the generated control voltage 815. As is seen in FIG. 8, when the value of the V-shaped waveform signal 810 is above that of the control voltage 815, the output from the first full-bridge inverter ($V_{FB1}$) 812 is zero. Thus, in this case, the compare unit 727 provides a control signal to a controller 745 which, in turn, controls the first and second drive units 262 and 264 so that the output from the first full-bridge inverter is low.

When the value of the V-shaped waveform signal 810 is below the control voltage 815, the compare unit 727 controls the half bridge drive controller 745 to switch the first half-bridge drive unit 262 and the second half-bridge drive unit 264 so that the output of the first full-bridge inverter ($V_{FB1}$) 812 is alternately high (positive) or low (negative). The polarity is controlled by the polarity of the signal from the VCO 720. The output of the first full-bridge inverter will be either high or low while ever the value of the V-shaped waveform signal 810 is below the control voltage 815.

Accordingly, with the above arrangement, as the phase (and frequency) of the V-shaped waveform is locked to the synchronisation pulse using the phase locked loop 725, the output of the full-bridge inverter 101 is symmetrical about the synchronisation pulses in the SYNC pulse train 305.

Although the above is described with reference to the first full-bridge inverter controller 261, the same features are present in the second full-bridge inverter controller 263. Thus, the V-shaped waveform 820 and the output 822 from the second full-bridge inverter 102 ($V_{FB2}$) are shown in FIG. 8. Similarly, a control voltage 825 is generated in the second full-bridge inverter controller 702. It is seen from FIG. 8 that the minimum points in the V-shaped waves generated in the first and second full-bridge inverter controllers 701, 702 are contemporaneous. Therefore both V-shaped waveforms are synchronised to the leading edge of pulses in the synchronisation pulse train 305. Moreover, the output pulses from the first and second full-bridge inverters are synchronised to, and symmetrical about, the pulses in the synchronisation pulse train 305.

Indeed, as the synchronisation pulse train 305 is fed into both the first and second full-bridge controllers, and both V-shaped waveforms are synchronised thereto, the provision of the V-shaped signals 810 and 820 ensure that the output from the first full-bridge inverter 101 and the second full-bridge inverter 102 is symmetrical about, and synchronised to, the leading edge of a pulse in the synchronisation pulse train 305. This means that the difference in pulse width between the outputs of the first and the second full bridge inverters, which is due to component and/or lamp tolerances, does not cause a phase difference between these outputs, as disclosed earlier.

It should be appreciated that although the foregoing describes locking to the leading edge of the synchronisation pulse, other points on the synchronisation pulse, such as the falling edge or middle may be used, as long as the output pulse from the full-bridge inverter is symmetrical with respect to this point of the synchronisation pulse train 305. Moreover, it is envisaged that similar advantageous results will be achieved even if the output is locked to a point that is not perfectly symmetrical.

Figure 11:
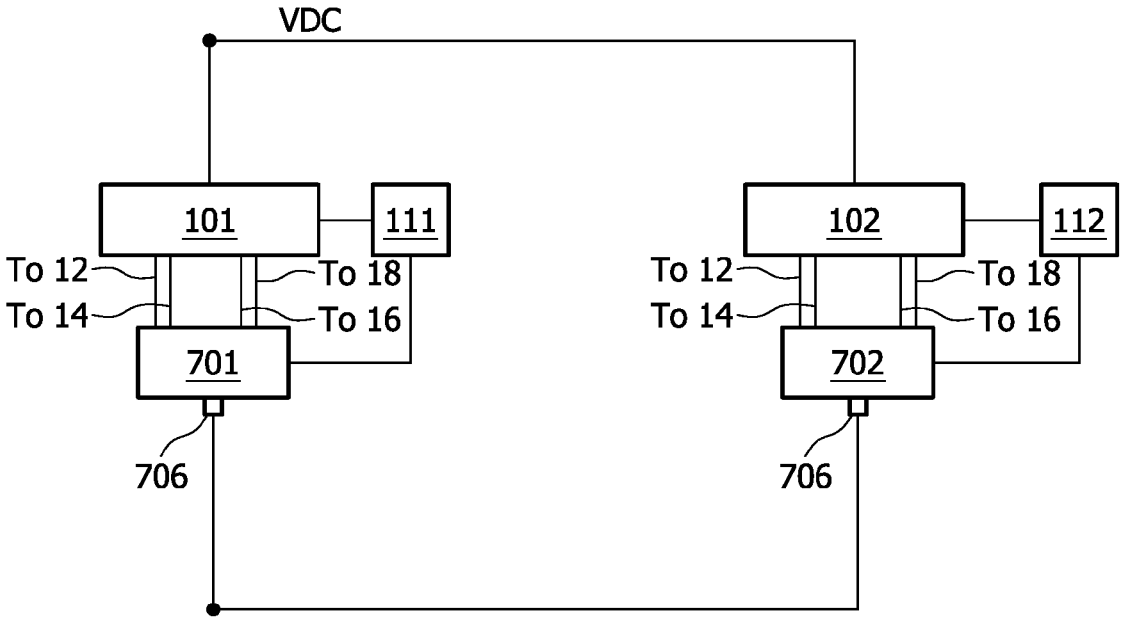
FIG. 11 depicts a full-bridge inverter array according to a second embodiment of the present invention.

The second embodiment of the present invention is depicted in FIG. 11. In this embodiment, the first and second full-bridge inverters synchronise with each other so no external SYNC pulse is required. Thus, instead of the external SYNC pulse train 305 being fed onto pin 706, pin 706 of the first and the second full-bridge inverter controllers are connected together.

As noted above, the VCO 720 of each of the first and second full-bridge inverter controllers will oscillate at its minimum oscillation frequency when no external pulse train is applied. Typically, due to manufacturing and load differences, the minimum oscillating frequency of the VCO 720 in the first and second full-bridge inverter controllers are different to one another.

For example, assuming that the minimum oscillating frequency of the first controller is higher than the minimum oscillating frequency of the second controller. Thus, when the pins 706 of the first and second controllers are connected together, the synchronisation logic 705 of the first controller 701 will place a pulse train on the pin 706 if the VCO 720 in the first controller 720 oscillates at its minimum frequency and similarly the synchronisation logic of the second controller 702 will place a pulse train on the pin 706 if the VCO 720 in the second controller 702 oscillates at its minimum frequency. The drivers of both pins 706 of both controllers 701 and 702, each consisting of a transistor 726 and a constant current load 729, form a wired OR gate. In this way the controllers can see each others pulses inbetween their own.

In-between placing the pulse on the pins, the synchronisation logic 705 in the respective controllers will listen to the pins 706 for other pulses. Accordingly, the synchronisation logic 705 in the second controller 705 will hear the pulse output from the first controller 701 between generating consecutive pulses. Conversely, if the VCO 720 in the second controller 702 oscillates at a frequency lower than the VCO 720 in the first controller 701, the synchronisation logic 705 of the first controller 701 will not hear the pulse from the second controller 702 in-between consecutive pulses being placed on the pin 705. Therefore, the first controller 701 knows to continue oscillating at its minimum oscillating frequency whereas the second controller 702 knows to synchronise to the pulses provided by the first controller 701.

Although the foregoing has been described with reference to two inverter controllers, it is understood that this invention is applicable to any number of inverter controllers. Preferably the foregoing is implemented on an Application Specific Integrated Circuit (ASIC) semiconductor device. However, Programmable Gate Array (PGA) and other forms of implementation, such as a digital signal processing system or a computer program are also envisaged.

Figure 12:
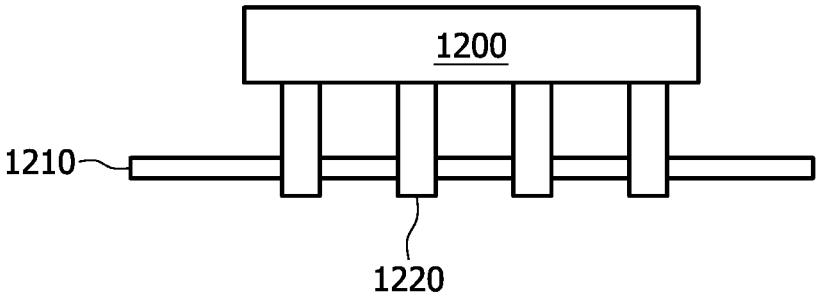
FIG. 12 depicts a semiconductor device having a controller according to the present invention provided thereon.

FIG. 12 depicts a semiconductor device 1200 having a controller according to the present invention provided thereon. The skilled person would appreciate that the semiconductor device 1200 has at least one leg 1220 which can be mounted on a printed circuit board 1210. Although FIG. 12 suggests that the semiconductor device 1200 is a through-hole component (leg sticking through the PCB), the preferred package is surface mount device (SMD), where at least one leg is attached to one of the sides of the PCB.

Figure 13:
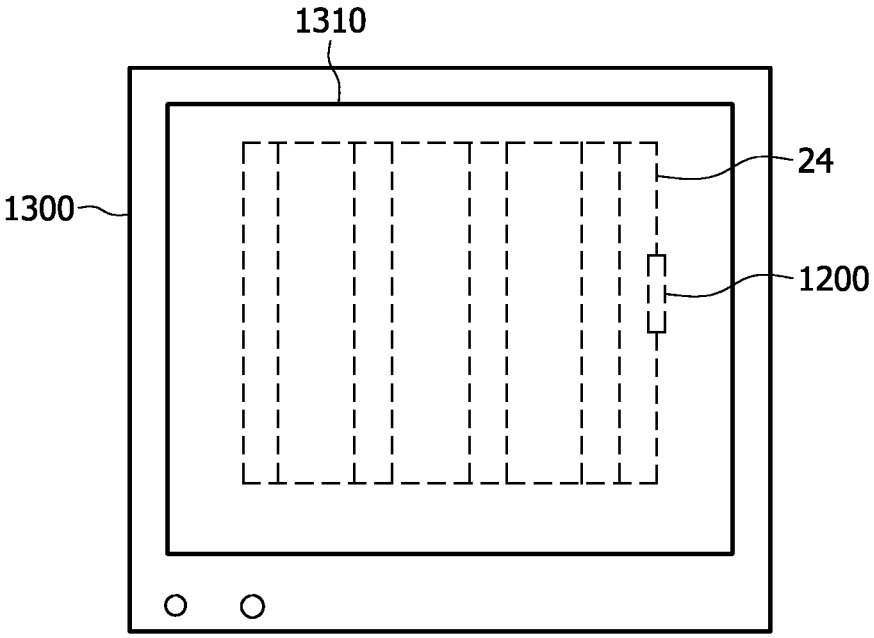
FIG. 13 depicts a television (display) panel including the semiconductor device of FIG. 12.

FIG. 13 depicts a television display panel 1300 into which the semiconductor device 1200 is mounted. The television 1300 consists of a pixel array 1310, behind which a backlight consisting of one or more lamps 24 is mounted; the lamps 24 being controlled by full-bridge inverters connected to the semiconductor device 1200 of FIG. 12. It will be understood that the full bridge inverter(s) including the semiconductor device(s) 1200 also can be mounted outside the panel. Although a television display panel is mentioned, the display can also be a PC monitor display or any display panel or other application where backlighting is required.

Although Claims have been formulated in this Application to particular combinations of features, it should be understood that the scope of the disclosure of the present invention also includes any novel features or any novel combination of features disclosed herein either explicitly or implicitly or any generalisation thereof, whether or not it relates to the same invention as presently claimed in any Claim and whether or not it mitigates any or all of the same technical problems as does the present invention. The Applicants hereby give notice that new Claims may be formulated to such features and/or combinations of such features during the prosecution of the present Application or of any further Application derived therefrom.

The invention claimed is:

1. A controller for controlling first and second full-bridge inverter, comprising control means for staggering timing of the switching of the outputs from the first and the second full-bridge inverter; and wherein the control means is operable to stagger the timing of the switching by controlling the output of the first and second inverter to be substantially symmetrical about a point on a synchronization pulse in a received synchronization pulse train.

2. A controller according to claim 1, comprising an oscillator for generating a periodic signal whose frequency is a multiple integer of the frequency of the received synchronization pulse train.

3. A controller according to claim 2, wherein control means is arranged so that the output of each full-bridge inverter is a pulse which is symmetrical about the same point on the generated signal.

4. A controller according to claim 3, wherein the oscillator is arranged so that the generated signal is a V-shaped signal and the periodic point on the generated signal is substantially the minimum or maximum value.

5. A controller according to claim 3, wherein the oscillator is arranged so that the generated signal is a saw-tooth signal and the periodic point on the generated signal is along the sloping edge of the sawtooth signal.

6. A controller according to claim 2, comprising synchronization logic for generating a pulse train in accordance with the generated periodic signal.

7. A controller according to claim 6, wherein the synchronization logic is operable to receive the synchronization pulse train and to synchronize the generated periodic signal to either the received synchronization pulse train or the generated pulse train having the highest frequency.

8. A device having a first controller according to claim 6 in communication with a second controller, wherein the first controller generates the synchronization pulse used by the second controller.

9. A controller according to claim 2 comprising a control voltage generating means for generating a control signal, wherein the width of the output pulse from the or each inverter is determined in accordance with the value of the control signal.

10. A controller according to claim 9, wherein the width of the output pulse from each inverter is determined by the generated periodic signal being less than the control signal.

11. A controller according to claim 1, wherein each inverter is connected to a resonant load and the control means is operable to generate each output pulse in accordance with the power requirements of the load.

12. A controller according to claim 1, wherein the control means is arranged to synchronize the output from each full-bridge inverter to be symmetrical about the same point in successive pulses.

13. A semiconductor integrated circuit, comprising: at least one pin connectable to a printed circuit board; and a controller according to claim 1.

14. A display panel comprising: a backlight; a pixel array; and a semiconductor integrated circuit according to claim 13 connected to said backlight, for control thereof.

15. A method of controlling a first and second full-bridge inverter, comprising staggering timing of a switching of outputs from the first and the second full-bridge inverter; and wherein the staggering of the timing of the switching is done by controlling the output of the first and second inverter to be substantially symmetrical about a point on a synchronization pulse in a received synchronization pulse train.

16. A control device of inverter controllers for controlling an array of full-bridge inverters, the device comprising:

a first and a second full bridge inverter controller for controlling the output of a first and a second full-bridge inverter; and each controller comprising: synchronization means operable to generate a first and a second synchronization signal for the first and the second full bridge inverter controller respectively; wherein each controller is arranged to control the first and the second output pulse to be substantially symmetrical about a substantially coincident point on the first and second synchronization signal.

17. A device according to claim 16, wherein the first and second full-bridge inverter controllers comprise: a first and a second output signal control means operable to generate a first and a second control signal respectively, wherein the width of the first and the second output pulse is determined in accordance with the value of the first and the second control signal.

18. A device according to claim 17, wherein the duration of the first and second output pulse is determined by the duration of the first and second synchronization signal being less than the first and the second control signal.

19. A device according to claim 16, wherein the synchronization means is operable to generate a V-shaped first and second synchronization signal.

20. A device according to claim 16, wherein the coincident point is the minimum or maximum value of the first and second synchronization signal.

21. A device according to claim 16, wherein the synchronization means is operable to receive a synchronization pulse train to synchronize the first and the second synchronization signal thereto.

22. A device according to claim 21, wherein the synchronization means is operable to generate the first and second synchronization signals having a frequency of twice that of the synchronization pulse train.

23. A device according to claim 16, wherein the first and the second inverter are connected to a first and a second resonant load.

24. A device according to claim 23, wherein the controllers are operable to generate the first and the second output pulse in accordance with the power requirements of the first and the second resonant load.

25. A semiconductor integrated circuit, comprising: at least one pin connectable to a printed circuit board; and a device according to claim 16.

26. A display panel comprising: a backlight; a pixel array; and a semiconductor integrated circuit according to claim 25 connected to said backlight, for control thereof.

27. A device according to claim 16, wherein the first and second full-bridge inverters each comprise a first and a second half bridge inverter, wherein the controller is operable to generate the output pulse from the full-bridge inverters in accordance with the phase difference between the first and second half bridge inverters.

28. A method of controlling a first and a second output pulse from a first and second full-bridge inverter, comprising:

generating a first and a second synchronization signal for a first and the second full bridge inverter controller, and controlling the first and the second output pulse to be substantially symmetrical about a substantially coincident point on the first and second synchronization signal.

29. A method according to claim 28, comprising: generating a first and a second control signal wherein the width of the first and the second output pulse is determined in accordance with the value of the first and the second control signal.

* * * * *